US005278615A

United States Patent [19]

Landa

[11] Patent Number: 5,278,615

[45] Date of Patent: Jan. 11, 1994

[54] LIQUID TONER IMAGING SYSTEM

[75] Inventor: Benzion Landa, Edmonton, Canada

[73] Assignee: Spectrum Sciences B.V., The Hauge, Netherlands

[21] Appl. No.: 960,371

[22] PCT Filed: Jul. 23, 1990

[86] PCT No.: PCT/NL90/00100

§ 371 Date: Jan. 22, 1993

§ 102(e) Date: Jan. 22, 1993

[87] PCT Pub. No.: WO92/01974

PCT Pub. Date: Feb. 6, 1992

[51] Int. Cl.[5] ..... G03G 15/10

[52] U.S. Cl. ..... 355/256; 118/645; 118/651; 118/659; 355/327

[58] Field of Search ..... 355/256, 257, 258, 326, 355/327, 260; 118/645, 659, 660, 661, 647, 651, 693, 694; 222/189, DIG. 1; 210/195.2, 257.2

[56] References Cited

U.S. PATENT DOCUMENTS

| | | | |
|---|---|---|---|
| 3,991,709 | 11/1976 | Sato et al. | 355/256 X |
| 4,193,683 | 3/1980 | Langner | 355/256 |
| 4,264,185 | 4/1981 | Ohta | 355/326 |
| 4,439,035 | 3/1984 | Landa | 355/307 |
| 4,579,253 | 4/1986 | Shenier | 222/DIG. 1 X |
| 4,634,252 | 1/1987 | Jeremijevic | 355/256 X |
| 4,794,651 | 12/1988 | Landa et al. | 430/110 |
| 4,827,309 | 5/1989 | Kato | 355/256 |
| 4,860,924 | 8/1989 | Simms et al. | 355/256 X |
| 4,974,541 | 12/1990 | Miyabayashi | 355/256 X |

FOREIGN PATENT DOCUMENTS

| | | | |
|---|---|---|---|
| 0148676 | 12/1984 | European Pat. Off. . | |
| 0026137 | 3/1978 | Japan | 355/256 |
| 2177626 | 1/1987 | United Kingdom . | |

*Primary Examiner*—A. T. Grimley
*Assistant Examiner*—Robert Beatty
*Attorney, Agent, or Firm*—Sandler Greenblum & Bernstein

[57] ABSTRACT

A multi-color liquid toner electrophotographic apparatus includes an image bearing surface, a developing apparatus for developing an image on the image bearing surface using a plurality of liquid toners of different colors and a transferring apparatus for transferring the developed image from the image bearing surface to a substrate. The developing apparatus includes a plurality of colored liquid toner reservoir volumes each for a different color which are separated by a barrier which prevents pigmented particle communication therebetween and permits communication of carrier liquid therebetween.

19 Claims, 2 Drawing Sheets

LIQUID TONER IMAGING SYSTEM

FIELD OF THE INVENTION

The present invention relates generally to electrophotography and more particularly to multi-color liquid toner replenishment systems.

BACKGROUND OF THE INVENTION

Liquid toner compositions for use in liquid toner imaging systems normally comprise a carrier liquid and toner particles. These two components deplete at different rates from a liquid toner supply reservoir which is normally part of such systems. The relative component depletion rates are dependent on the percent coverage of the images produced by the imaging system and on other factors.

Imaging systems, be they printers or copiers, generally produce a variety of images having a wide range of print coverage. In general, the relative depletion rates of the various components of liquid toner will depend on the print coverage. It is well known that the balance between the various components of a liquid toner can have a strong effect on the quality of printed images, therefore most imaging systems have replenishment systems. These systems include replenishment with toner concentrate, having a relatively high percentage of particles and also containing carrier liquid, and with carrier liquid free of toner particles. One or both of these replenishment components may have charge director added thereto, or charge director may be supplied in a separate charge director replenishment solution.

Toner concentrate is added whenever the liquid toner becomes depleted of toner particles. The concentration of toner particles may be determined by measuring the optical density of the liquid toner composition in the reservoir. Carrier liquid is supplied whenever the total amount of liquid toner in the reservoir falls below a certain level. Charge director may be added when the conductivity of the solution is reduced.

An exemplary system for the replenishment of liquid toner components is described in U.S. Pat. No. 4,860,924 the disclosure of which is incorporated herein by reference.

The liquid carrier supply generally includes apparatus for the measurement of the liquid level in the reservoir, and a series of pumps and or valves which are operated in response to a signal from the measurement system to replenish the carrier liquid in the reservoir by pumping or otherwise transporting carrier liquid from the carrier liquid replenishment supply.

In color systems, liquid toners of different colors are required, each having a separate replenishment system for toner particle concentrate and for carrier liquid, including separate measurement and supply systems. These separate systems add to the expense and complication of such systems and reduce their reliability.

SUMMARY OF THE INVENTION

The present invention seeks to provide improved multicolor liquid toner electrophotographic apparatus.

In particular the present invention seeks to reduce the complexity of such apparatus by reducing the number of liquid carrier and/or charge director replenishment systems, preferably to one system of each type, for replenishment of all the colors.

There is thus provided in accordance with a preferred embodiment of the present invention multi-color liquid toner electrophotographic apparatus including an image bearing surface, apparatus for developing an image on the image bearing surface using a plurality of liquid toners of different colors each including carrier liquid and pigmented particles and apparatus for transferring a developed image from the image bearing surface to a substrate, wherein the apparatus for developing includes a plurality of colored liquid toner reservoir volumes, each for a different color, which are separated by a barrier which prevents pigmented particle communication therebetween and permits communication of carrier liquid therebetween.

In accordance with a preferred embodiment of the invention, the apparatus for developing comprises a carrier liquid supply reservoir which communicates with the plurality of colored liquid toner reservoir volumes via a barrier which prevents pigmented particle communication therebetween and permits communication of carrier liquid therebetween.

Preferably the barrier comprises a membrane defining passages of diameter between 0.3 and 0.6 microns.

Additionally in accordance with an embodiment of the invention, the carrier liquid supply reservoir is in direct communication via the barrier with each of the plurality of colored liquid toner reservoirs separately.

Alternatively the carrier liquid supply reservoir communicates via the plurality of colored liquid toner reservoirs in a series arrangement.

In a preferred embodiment of the invention the apparatus includes liquid level indicator apparatus responsive to the total quantity of liquid toner in the liquid toner reservoir volumes, and carrier liquid supply apparatus responsive to the liquid level indicator apparatus for supplying carrier liquid to the liquid toner reservoir volumes. In a preferred embodiment of the invention the carrier liquid is supplied into the supply reservoir.

In a preferred embodiment of the invention, where the liquid toner includes charge director in the carrier liquid, the apparatus also includes charge director concentration measurement apparatus responsive to the concentration of the charge director in the carrier liquid, and charge director supply apparatus responsive to the charge director concentration apparatus for supplying charge director to the reservoir volumes. In a preferred embodiment of the invention the charge director concentration apparatus is responsive to the concentration of the charge director in the carrier liquid in the carrier liquid supply reservoir, and the charge director is supplied to the carrier liquid supply reservoir.

There is further provided multi-color liquid toner electrophotographic apparatus including an image bearing surface, apparatus for developing an image on the image bearing surface using a plurality of liquid toners of different colors each including carrier liquid and pigmented particles and apparatus for transferring a developed image from the image bearing surface to a substrate, wherein the apparatus for developing includes a plurality of colored liquid toner reservoir volumes, each for a different color, liquid level indicator apparatus responsive to the total quantity of liquid toner in the liquid toner reservoir volumes and carrier liquid supply apparatus responsive to the liquid level indicator means for supplying carrier liquid to the liquid toner reservoir volumes.

In a preferred embodiment of the invention the liquid toner reservoir volumes are separated by a barrier which prevents pigmented particle communication therebetween and permits communication of carrier liquid therebetween.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
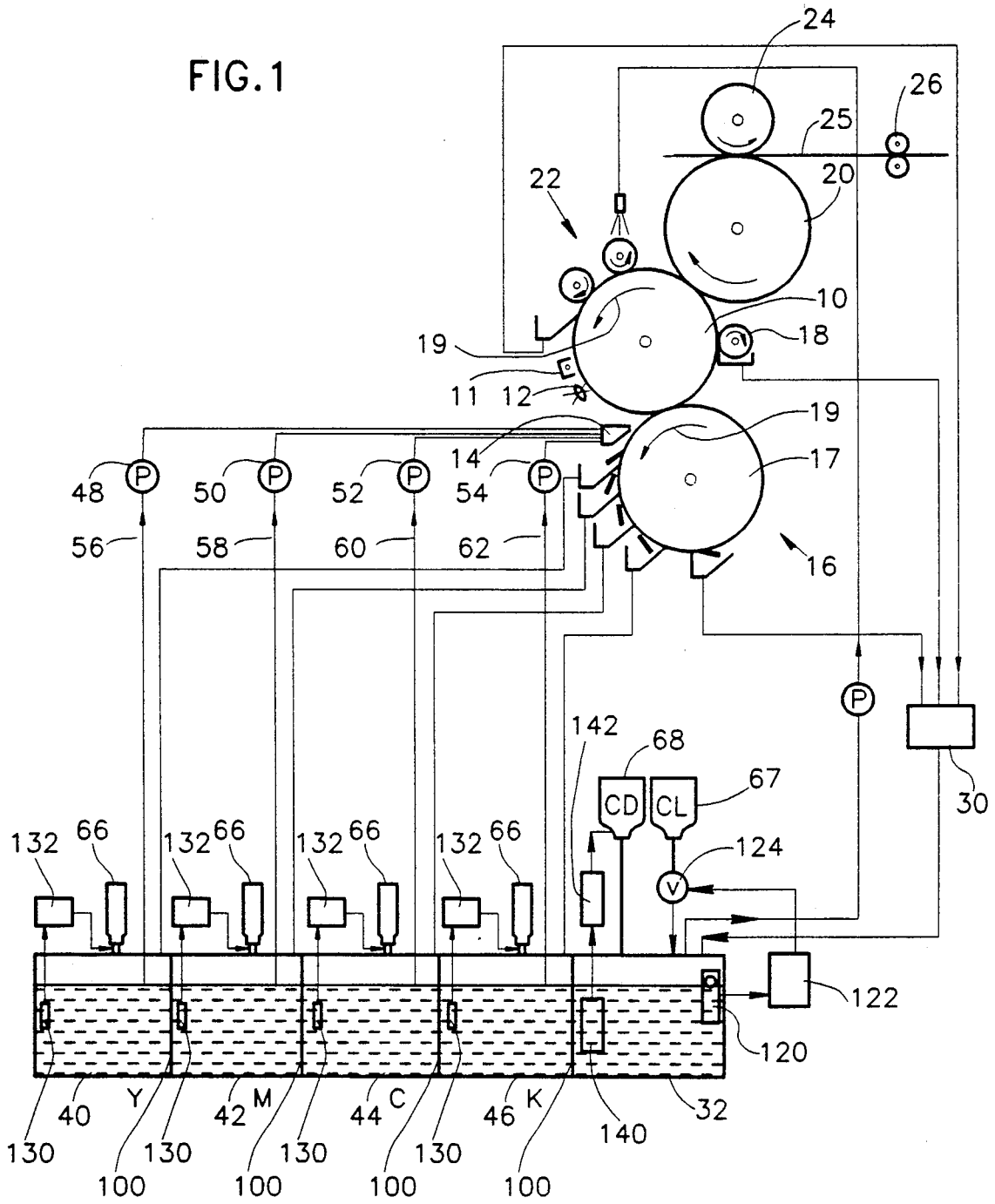
FIG. 1 is a generalized illustration of multi-color electrophotographic apparatus constructed and operative in accordance with a preferred embodiment of the present invention.

Reference is now made to FIG. 1 which illustrates a multicolor electrostatic imaging system constructed and operative in accordance with a preferred embodiment of the present invention. As seen in FIG. 1, there is provided an image bearing surface typically embodied in a rotating photoconductive drum 10. Operatively associated with photoconductive drum 10 is photoconductor charging apparatus 11 and imaging apparatus 12, for providing a desired latent image on drum 10. The latent image normally includes image areas at a first electrical potential and background areas at another electrical potential.

Also associated with photoconductive drum 10 are a multicolor liquid developer spray assembly 14, a developing assembly 16, an excess liquid removal assembly 18, an intermediate transfer member 20 and a cleaning station 22. The above-mentioned assemblies are described in greater detail in commonly assigned PCT patent application Ser. No. PCT/NL90/00069, filed May 14, 1990, the disclosure of which is incorporated herein by reference.

The developing assembly 16 preferably includes a developer roller electrode 17 spaced from the photoconductive drum 10 and typically rotating in the same sense as drum 10, as indicated by arrows 19. This rotation provides for the surface of drum 10 and roller 17 to have opposite velocities in their region of propinquity.

Photoconductive drum 10, photoconductor charging apparatus 11 and imaging apparatus 12 may be any suitable drum, charging apparatus and imaging apparatus such as are well known in the art. Developing assembly 16 is of particular construction several embodiments of which are described in detail in the above referenced PCT application.

Excess liquid removal assembly 18 typically includes a biased squeegee roller preferably formed of resilient conductive polymeric material, and charged to a potential of several hundred to a few thousand volts with the same sign as the sign of the charge on the toner particles.

Intermediate transfer member 20 may be any suitable intermediate transfer member such as those described in commonly assigned U.S. patent applications Ser. Nos. 306,062 now U.S. Pat. No. 4,999,677 filed Feb. 6, 1989, and 393,649 now U.S. Pat. No. 5,047,808 filed Aug. 14, 1989, the disclosures of which are incorporated herein by reference, and is arranged for electrophoretic transfer thereto of the image from the image bearing surface. Intermediate transfer member 20 is preferably associated with a pressure roller 24 for subsequent transfer of the image onto a further substrate 25, such as paper, preferably by heat and pressure. A fuser 26 may be associated with the substrate 25, for fixing the image thereon, if required. Cleaning station 22 may be any suitable cleaning station, such as that described in U.S. Pat. No. 4,439,035, the disclosure of which is incorporated herein by reference.

In accordance with a preferred embodiment of the invention, after developing each image in a given color, the single color image is transferred to intermediate transfer member 20. Subsequent images in different colors are sequentially transferred onto intermediate transfer member 20. When all of the desired images have been transferred thereto, the complete multi-color image is transferred from transfer member 20 to substrate 25. Pressure roller 24 therefore only produces operative engagement between intermediate transfer member 20 and substrate 25 when transfer of the composite image to substrate 25 takes place.

Alternatively, each single color image is transferred to the paper after its formation. In this case the paper is fed through the machine once for each color or is held on a platen and contacted with intermediate transfer member 20 during image transfer. As a further alternative, the intermediate transfer member is omitted and the developed single color images are transferred sequentially directly from drum 10 to substrate 25.

According to a preferred embodiment of the invention, excess liquid, containing toner particles of the particular color being printed, is collected from cleaning station 22, excess liquid removal assembly 18 and developer assembly 16 and supplied to a separator 30 which is operative to separate relatively clean carrier liquid from the various colored toner particles. The separator may typically be of the type described in commonly assigned U.S. patent application Ser. No. 319,124, now abandoned filed Mar. 6, 1989, the disclosure of which is hereby incorporated herein by reference. Clean carrier liquid is supplied from separator 30 to a carrier liquid reservoir 32, which also may receive additional supplies of carrier liquid, as necessary, from a supply container 67. Carrier liquid from reservoir 32 is supplied to cleaning station 22.

Multicolor toner spray assembly 14 receives separate supplies of colored toner from four different reservoirs 40, 42, 44 and 46, typically containing Yellow, Magenta, Cyan and Black liquid toners respectively. Pumps 48, 50, 52 and 54 may be provided along respective supply conduits 56, 58, 60 and 62 for providing a desired amount of pressure to feed the colored toner to multicolor spray assembly 14.

A preferred set of toners for use in the present invention is produced by the following process:

Black Toner

Step I: 1000 grams of Elvax II 5950 resin (DuPont) and 500 grams of Isopar L (Exxon) are mixed and heated in a Ross oil jacketed double planetary mixer (Charles Ross and Son, Hauppauge, N.Y.) with an oil temperature of 130° C. for one hour. 250 grams of Mogul-L carbon black, wetted with 500 grams of Isopar L is added to the mixer and the mixing is continued for an additional hour at a speed control setting of 6.2000 grams of Isopar L, preheated to 110° C. are added and mixing is continued for an additional hour. The heat is turned off and mixing is continued until the temperature drops to 40° C.

Step II: 1150 grams of the resulting mixture is mixed with 850 grams of Isopar L and charged into a Union Process S-1 attritor (Union Process, Akron, Ohio.), filled with 0.47625 cm (3/16") carbon steel balls. The material is ground for 61 hours with the cooling system of the attritor set to about 30° C. The resultant particles are formed with tendril like extensions and have an average diameter of about 1.5 microns as measured by a Shimadzu Model SA-CP3 Centrifugal Particle Size Analyzer (Shimadzu Corp. Kyoto, Japan).

Cyan Toner

Step I: 1400 grams of Elvax II 5950 resin (DuPont) and 700 grams of Isopar L (Exxon) are mixed and heated in a Ross oil jacketed double planetary mixer with an oil temperature of 130° C. for one hour. 1900 grams of Isopar L, preheated to 110° C. are added and mixing is continued for an additional hour. The heat is turned off and mixing is continued until the temperature drops to 40° C.

Step II: 1067 grams of the resulting mixture is mixed with 1210 grams of Isopar L, 17.6 grams of Lionol Blue FG 7351 and 5.85 grams of Aluminum Stearate and charged into a Union Process S-1 attritor, filled with 0.47625 cm (3/16") carbon steel balls. The material is ground for 23 hours with the cooling system of the attritor set to about 30° C. The resultant particles are formed with tendril like extensions and have an average diameter of about 1.1 microns.

Magenta Toner

Step I is the same as step I for the Cyan toner.

Step II: 1033.35 grams of the resulting mixture is mixed with 1231.47 grams of Isopar L, 23.37 grams of Lionol Rubin D-4576, 1.95 grams of Sicometh Yellow D-1350 and 5.86 grams of Aluminum Stearate and charged into a Union Process S-1 attritor, filled with 0.47625 cm (3/16") carbon steel balls. The material is ground for 25 hours with the cooling system of the attritor set to about 30° C. The resultant particles are formed with tendril like extensions and have an average diameter of about 1.4 microns.

Yellow Toner

Step I is the same as for Cyan toner.

Step II: 422.8 grams of the resulting mixture, 843.4 grams of Isopar L, 12 grams of Lionol Yellow FG 1310 and 1.6 grams of Aluminum Stearate are ground together in a Dynomill model KDL 1.4 L (Willy A. Bachofen A. G., Basle, Switzerland) containing 2–2.5 mm zircon media, while cooled to 35° C. for 4 hours. The resultant particles are formed with tendril like extensions and have an average diameter of about 1.42 microns.

In each case the toner particles are formed with a plurality of fibrous extensions or tendrils as described in U.S. Pat. No. 4,794,651, the disclosure of which is incorporated herein by reference.

Toner is made by diluting this concentrated material to 1.5% solids by adding additional Isopar L. Charge director as is known in the art is added to charge the toner particles. Preferably the charge directors described in commonly assigned U.S. patent application Ser. No. 7/354,121 now U.S. Pat. No. 5,047,306 filed May. 22, 1989, the disclosure of which is incorporated herein by reference, is used.

In a preferred embodiment of the present invention the conductance of each of these liquid toners is adjusted to be the same. A value of 60 picomhos has been found to be a suitable conductance.

In an alternative preferred embodiment of the invention the charge directors disclosed in commonly assigned U.S. patent application Ser. No. 7/533,765 now U.S. Pat. No. 5,208,130 entitled IMPROVED CHARGE DIRECTOR COMPOSITIONS FOR LIQUID DEVELOPER, the disclosure of which is incorporated herein by reference, is used. These charge directors have the unusual characteristic that the charge director is associated only with the toner particles and none of the charge director is dissolved in the carrier liquid.

Associated with each of reservoirs 40, 42, 44 and 46 are typically provided containers 66 of concentrated toner material.

According to a preferred embodiment of the invention, the individual reservoirs 40, 42, 44 and 46 are separated from adjacent reservoirs by a barrier 100, which prevents pigmented particle communication therebetween but permits communication of carrier liquid therebetween. According, in accordance with a preferred embodiment of the invention, carrier liquid is provided to each of reservoirs 40, 42, 44 and 46 via barriers 100 from carrier liquid reservoir 32.

Measurement of the liquid level is preferably performed by the use of a float mechanism 120 in any one of the individual reservoirs or in the liquid reservoir 32. When the liquid level is low, a signal from float mechanism 120 activates a carrier liquid dispenser control 122 to open valve 124, to allow a predetermined amount of carrier liquid to flow from a carrier liquid refill bottle 67 into carrier liquid reservoir 32.

The optical density of each of the colored toner dispersions is preferably separately measured by an optical density measurement circuit 130. Exemplary forms of such apparatus are shown in U.S. Pat. Nos. 4,579,253 or 4,860,924, the disclosures of which are incorporated herein by reference. A signal responsive to the density is fed into a toner dispenser control system 132 which is operative to dispense a given amount of toner concentrate from containers 66 into the specific reservoir.

If one of the charge directors of the above mentioned U.S. patent application Ser. No. 7/533,765, is used, then no replenishment of charge director separate from the toner concentrate is believed necessary. On the other hand if the charge director of U.S. patent application Ser. No. 7/354,121 is used or if conventional charge directors are used then separate replenishment of charge director may be required. In this case conductivity measuring apparatus 140 is used to determine a low conductivity condition, preferably in reservoir 32. If a low conductivity condition exists, then a signal from apparatus 140 activates a charge director control circuit 142 to release a measured amount of charge director solution from supply container 68 into reservoir 32. U.S. Pat. No. 4,860,924 shows exemplary apparatus for carrying out the charge director replenishment function.

It will be appreciated that both the liquid levels and charge director levels are automatically maintained uniform for all of the reservoirs 40, 42, 44 and 46 by the flow of the carrier liquid through the barriers under gravity.

Each of the reservoirs 40, 42, 44 and 46 also typically receives an input of recycled toner of a corresponding color from developer assembly 16.

According to a preferred embodiment of the invention, the barriers 100 each comprise a membrane defining passages of diameter small enough to stop passage of toner particles without clogging, but large enough to allow free flow of carrier liquid and charge director if present. The passages have a diameter preferably between 0.3 and 0.6 microns.

In practice hole size is dependent on the toner particle and charge director sizes and is chosen to suit the particular toner. Some charge directors will not pass completely through a membrane having passages suitable for blocking the toner particles. In these cases separate conductivity measurement and charge director supply systems may be required for each of the colored toner reservoirs.

Smaller passage diameters can be utilized if passage of charge director is not desired, as for example if the charge director of U.S. patent application Ser. No. 7/533,765 is used or if the charge director level for the different toners is to be different for the different color toners. For this later embodiment of the invention, separate conductivity measurement and charge director supply systems are provided for each color toner.

A suitable membrane is commercially available from Nuclepore Corporation of Pleasanton, Calif., under the trade name Nuclepore. This membrane is very thin, has a flat surface and has geometric shaped, nearly circular passages.

Figure 2:
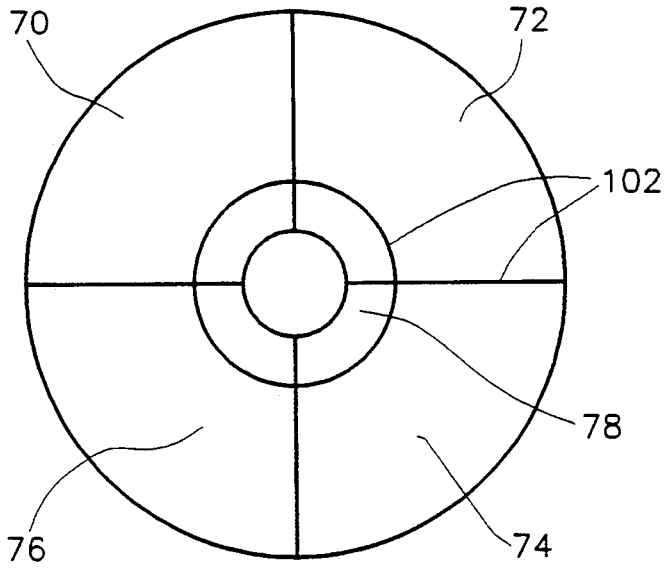
FIG. 2 is a simplified illustration of a top view of an alternative embodiment of toner reservoir arrangement constructed and operative in accordance with an embodiment of the present invention.

In the embodiment of FIG. 1, the carrier liquid supply reservoir communicates in a series arrangement with colored liquid toner reservoirs 46, 44, 42 and 46. In accordance with an alternative embodiment, illustrated in FIG. 2, the various colored liquid toner reservoirs, here indicated by reference numerals 70, 72, 74 and 76, are arranged around a central carrier liquid reservoir 78 and are separated from each other and from reservoir 78 by a barrier 102 which may be functionally identical to barrier 100.

It will be appreciated by persons skilled in the art that the present invention is not limited to what has been particularly shown and described hereinabove. Rather the scope of the present invention is defined only by the claims which follow:

I claim:

1. Multi-color liquid toner electrophotographic apparatus comprising:

an image bearing surface;

a development system operative to develop an image on the image bearing surface using a plurality of liquid toners of different colors each comprising carrier liquid and pigmented particles; and means for transferring a developed image from the image bearing surface to a substrate, wherein the development system includes a plurality of colored liquid toner reservoir volumes, each for a different color, and the reservoir volumes are separated by a barrier which prevents pigmented particle communication therebetween and permits communication of carrier liquid therebetween.

2. Apparatus according to claim 1 and also comprising;

a liquid level indicator responsive to the total quantity of liquid toner in said liquid toner reservoir volumes; and a carrier liquid supply system responsive to said liquid level indicator and operative to supply carrier liquid to said liquid toner reservoir volumes.

3. Apparatus according to claim 1 wherein the development system comprises a carrier liquid supply reservoir which communicates with the plurality of colored liquid toner reservoir volumes via barriers which prevent pigmented particle communication therebetween and permits communication of carrier liquid therebetween.

4. Apparatus according to claim 3 wherein said carrier liquid supply reservoir is in direct communication via said barriers with each of the plurality of colored liquid toner reservoirs separately.

5. Apparatus according to claim 3 and wherein said carrier liquid supply reservoir communicates with said plurality of colored liquid toner reservoirs via a series arrangement.

6. Apparatus according to claim 1 wherein said barrier comprise a membrane defining passages of diameter less than about 0.6 microns.

7. Apparatus according to claim 1 wherein said barrier comprise a membrane defining passages of diameter greater than about 0.3 microns.

8. Apparatus according to claim 1 wherein said liquid toners also include charge director in said carrier liquid, said apparatus also including:

a charge director concentration measurement system responsive to the concentration of said charge director in said carrier liquid; and a charge director supply system responsive to said charge director concentration measurement system and operative to supply charge director to said reservoir volumes.

9. Apparatus according to claim 3, wherein said liquid toners also include charge director in said carrier liquid, said apparatus also including:

a charge director concentration measurement system responsive to the concentration of said charge director in said carrier liquid in said carrier liquid supply reservoir; and a charge director supply system responsive to said charge director concentration measurement system and operative to supply charge director to said carrier liquid supply reservoir.

10. Apparatus according to claim 3 wherein said liquid toners also include charge director in said carrier liquid, said apparatus also including:

a charge director concentration measurement system responsive to the concentration of said charge director in said carrier liquid; and a charge director supply system responsive to said charge director concentration measurement system and operative to supply charge director to said reservoir volumes.

11. Multi-color liquid toner electrophotographic apparatus comprising:

an image bearing surface;

a development system operative to develop an image on the image bearing surface using a plurality of liquid toners of different colors each comprising carrier liquid and pigmented particles, wherein the development system includes a plurality of colored liquid toner reservoir volumes, each for a different color; and means for transferring a developed image from the image bearing surface to a substrate;

a liquid level indicator responsive to the total quantity of liquid toner in said liquid toner reservoir volumes; and a carrier liquid supply system responsive to said liquid level indicator and operative to supply carrier liquid to said liquid toner reservoir volumes.

12. Apparatus according to claim 11 wherein the development system comprises a carrier liquid supply reservoir which communicates with the plurality of colored liquid toner reservoir volumes via barriers which prevent pigmented particle communication therebetween and permits communication of carrier liquid therebetween.

13. Apparatus according claim 12 wherein said barriers comprise a membrane defining passages of diameter less than about 0.6 microns.

14. Apparatus according claim 12 wherein said barriers comprise a membrane defining passages of diameter greater than about 0.3 microns.

15. Apparatus according to claim 12 wherein said carrier liquid supply reservoir is in direct communication via said barriers with each of the plurality of colored liquid toner reservoirs separately.

16. Apparatus according to claim 12 and wherein said carrier liquid supply reservoir communicates with said plurality of colored liquid toner reservoirs via a series arrangement.

17. Apparatus according to claim 12, wherein said liquid toners also include charge director in said carrier liquid, said apparatus also including:

a charge director concentration measurement system responsive to the concentration of said charge director in said carrier liquid in said carrier liquid supply reservoir; and a charge director supply system responsive to said charge director concentration measurement system and operative to supply charge director to said carrier liquid supply reservoir.

18. Apparatus according to claim 11 wherein said liquid toners also include charge director in said carrier liquid, said apparatus also including:

a charge director concentration measurement system responsive to the concentration of said charge director in said carrier liquid; and a charge director supply system responsive to said charge director concentration measurement system and operative to supply charge director to said reservoir volumes.

19. Apparatus according to claim 12 wherein said liquid toners also include charge director in said carrier liquid, said apparatus also including:

a charge director concentration measurement system responsive to the concentration of said charge director in said carrier liquid; and a charge director supply system responsive to said charge director concentration measurement system and operative to supply charge director to said reservoir volumes.

* * * * *